US009968863B2

(12) United States Patent
Sanders et al.

(10) Patent No.: US 9,968,863 B2
(45) Date of Patent: May 15, 2018

(54) BOBBLING TOY EXCITER

(71) Applicants: Steven Sanders, Cottonwood, CA (US); Seth Alexander Harvey, Chico, CA (US); Timothy J. Sais, Hesperia, CA (US)

(72) Inventors: Steven Sanders, Cottonwood, CA (US); Seth Alexander Harvey, Chico, CA (US); Timothy J. Sais, Hesperia, CA (US)

( * ) Notice: Subject to any disclaimer, the term of this patent is extended or adjusted under 35 U.S.C. 154(b) by 0 days. days.

(21) Appl. No.: 14/949,781

(22) Filed: Nov. 23, 2015

(65) Prior Publication Data

US 2016/0175728 A1 Jun. 23, 2016

Related U.S. Application Data

(60) Provisional application No. 62/083,096, filed on Nov. 21, 2014.

(51) Int. Cl.
*A63H 33/00* (2006.01)
*A63H 29/22* (2006.01)
*A63H 13/18* (2006.01)

(52) U.S. Cl.
CPC ..... *A63H 29/22* (2013.01); *A63H 13/18* (2013.01)

(58) Field of Classification Search
CPC ..... A63H 13/18; A63H 29/22
USPC ..... 446/227, 330, 396, 486, 490
See application file for complete search history.

(56) References Cited

U.S. PATENT DOCUMENTS 1,280,508 A * 10/1918 McHenry ..... G01P 1/127 235/95 R
1,845,137 A * 2/1932 Disser, Sr. ..... G09F 11/23 310/32
2,068,531 A * 1/1937 Blume ..... H02K 33/10 310/23
2,231,980 A * 2/1941 Wooten ..... G09F 19/08 446/274
2,557,242 A * 6/1951 Simpson ..... G09F 11/23 200/19.11
3,022,594 A * 2/1962 Wendell ..... G09F 19/12 40/319
3,803,735 A * 4/1974 Stubbmann ..... G04B 15/00 40/414
3,888,030 A * 6/1975 Bradt ..... G09F 19/02 40/411
4,097,917 A * 6/1978 McCaslin ..... G02B 6/0005 362/234

(Continued)

*Primary Examiner* — Melba Bumgarner
*Assistant Examiner* — Joseph B Baldori
(74) *Attorney, Agent, or Firm* — Ward Law Office LLC; Jacob M. Ward

(57) ABSTRACT

A bobbling toy exciter is provided for gently tapping the bobbling portion of the bobbling toy to create a continuous movement of the bobbling portion. A motor drives a flexible arm in periodic movement which causes the arm to strike the bobbling portion, for example the bobbling head of the toy. A bob or other mass may be added to the end of the flexible arm to more effectively strike the toy. The flexible arm may extend transversely from the shaft of a rotating motor. The flexible arm may also transversely extend from a pivoting vertical rod. The present bobbling toy exciter gently creates movement and action in bobbling toys which would require manual excitation, so that the user may continuously enjoy the bobbling movement.

5 Claims, 6 Drawing Sheets

(56) References Cited

U.S. PATENT DOCUMENTS 4,206,495 A * 6/1980 McCaslin ..... G02B 6/4298 362/234
4,422,530 A * 12/1983 Denton ..... F03G 3/06 185/29
4,728,871 A * 3/1988 Andrews ..... G09F 19/02 318/130
4,869,703 A * 9/1989 Ong ..... A63H 3/48 40/414
4,901,458 A * 2/1990 Belokin ..... G09F 19/02 40/414
4,930,448 A * 6/1990 Robinson ..... A01K 15/025 119/708
4,970,810 A * 11/1990 Liou ..... G09F 19/08 40/411
5,103,770 A * 4/1992 Berkovich ..... A01K 15/027 119/708
5,119,001 A * 6/1992 Moore ..... H02P 7/03 119/708
5,146,702 A * 9/1992 Belokin, Jr. ..... G09F 19/08 40/414
5,446,236 A * 8/1995 Nakada ..... G10F 5/02 446/298
5,462,471 A * 10/1995 Power-Fardy ..... A42B 1/004 2/195.1
5,657,721 A * 8/1997 Mayfield ..... A01K 15/025 119/707
5,675,225 A * 10/1997 Moore ..... A01K 15/025 119/708
5,732,493 A * 3/1998 Luedtke ..... G09F 19/02 40/411
5,823,844 A * 10/1998 Markowitz ..... A63H 11/02 119/707
5,925,838 A * 7/1999 Meng-Suen ..... G10D 13/08 446/336
5,941,196 A * 8/1999 Domanski ..... A01K 15/025 119/708
6,016,771 A * 1/2000 Baiera ..... A01K 15/025 119/707
6,038,812 A * 3/2000 Belokin ..... A01G 5/04 229/123.2
6,360,694 B1 * 3/2002 Noto ..... A01K 15/025 119/707
6,892,675 B1 * 5/2005 Comerford ..... A01K 15/025 119/706
7,895,779 B2 * 3/2011 Schnuckle ..... A63H 13/02 119/708
7,900,584 B2 * 3/2011 Suring ..... A01K 15/025 119/702
8,640,653 B2 * 2/2014 Cook ..... A01K 15/025 119/707
8,721,387 B2 * 5/2014 Coleman ..... A63H 29/22 446/236
2004/0017734 A1 * 1/2004 Stallinga ..... G04B 45/0053 368/223
2006/0264148 A1 * 11/2006 Sejnowski ..... A63H 33/006 446/227
2007/0289550 A1 * 12/2007 Huang ..... A01K 15/025 119/707
2010/0112898 A1 * 5/2010 Reyes ..... A63H 29/22 446/484
2011/0097964 A1 * 4/2011 Law ..... A63H 13/00 446/72
2012/0197309 A1 * 8/2012 Steele ..... A61B 17/7085 606/301
2013/0029558 A1 * 1/2013 Burton ..... G09F 19/02 446/72
2016/0175728 A1 * 6/2016 Sanders ..... A63H 13/18 446/486

* cited by examiner

BOBBLING TOY EXCITER

RELATED APPLICATION DATA

This application claims the priority date of provisional application Ser. No. 62/083,096 filed on Nov. 21, 2014.

BACKGROUND

The present invention relates to an accessory for use with a bobbling novelty toy, and more particularly, to accessory which aids in exciting the movable portion of the bobbling novelty toy.

Bobbling novelty toy dolls have portions of the toy which are mounted to the remainder of the toy by a spring or other hinge device to allow the portion to wobble relative to the remainder of the toy. These toys are also known as "bobble-head" toys. Most often, the head of the bobbling novelty toy dolls is the portion which is permitted to wobble relative to the body of the toy. However, other portions of the toy may wobble, such as the hips or legs. Furthermore, other bobbling novelty toys may be in the form of inanimate objects, flowers, and such.

The wobbling head variety of the bobbling novelty toy doll generally has the torso and legs of the doll rigidly mounted to a base, which, in turn, rests on a support surface, such as a shelf or a table. A neck portion extends up from the torso, with a spring connecting the head to the neck. Due to the spring mounting, the head is permitted to move relative to the torso upon being excited by an outside source, most normally a tap by the user or the movement of a car, if mounted within a car.

Some bobbling novelty toy dolls have internal motors or other means to excite the head or other wobbling portion, such that an external tap is not required. However, many modern and antique bobbling novelty toy dolls do not have an internal excitation means. Thus, with these manual dolls, the user must periodically tap the doll to excite the head. A user may wish the head of a rare or special bobbling novelty toy doll to bobble without continuously interacting with the doll.

Because many of these bobbling novelty toy dolls are collector's editions, rare, or were obtained on a special occasion, the owner generally desires to avoid altering the appearance or operation of the doll itself.

Thus, what is needed is a means to periodically excite the bobbling portion of a bobbling novelty toy doll. The means should not damage, change the original operation, or alter the appearance of the bobbling novelty toy doll.

SUMMARY

A bobbling toy exciter for exciting a bobbling portion of a bobbling toy is provided. The bobbling toy exciter is generally comprised of a flexible arm that moves with a periodic motion; a motor coupled with the flexible arm, the motor driving the periodic motion of the flexible arm when activated; a base supporting the motor and flexible arm, where the base is sufficiently weighted to prevent instability of the bobbling toy exciter during the periodic motion; and a power source providing power to the motor; where the base is positioned in proximity to the bobbling toy so that the flexible arm strikes the bobbling portion repeatedly to cause the bobbling portion to bobble.

Optionally, the base has a support surface for supporting the bobbling toy thereon. The base may have a first extension and a second extension, with a space between the first extension and the second extension to permit the bobbling toy to rest within the space. The flexible arm may be a wire, a bristle, a filament, a fiber or other sufficiently flexible elongate material.

As yet another option, the flexible arm may have a bob located on a distal end, where a proximal end of the flexible arm is coupled with the motor. A hub may be coupled to a shaft of the motor, with the proximal end of the flexible arm being coupled to the hub. The proximal end of the flexible arm may be rotationally coupled to the hub to permit the flexible arm to rotate about the hub.

Again optionally, a post extends upwardly from the base, an upward end of the post supporting the motor. The post may have a groove formed about it to provide a point of weakness so that the post can be selectively divided at the point of weakness to shorten the post. A motor cradle may be attached to the upward end of the post, where the motor is held within the motor cradle, and the flexible arm further comprises a bob located on a distal end, and a hub being coupled to the motor, with a proximal end of the flexible arm being coupled to the hub. A post may extend upwardly from the base, an upward end of the post supporting the motor with a joint between the motor and the post to permit tilting of the motor relative to the post. The flexible arm may extend axially from a shaft of the motor by a proximal end, with a bob being located on the distal end of the flexible arm.

Also optionally, a vertical rod may be provided with the flexible arm extending transversely from an upper portion. A mass is attached to a lower portion of the vertical rod. The vertical rod is connected by a pivot to the base at a portion between the upper portion and the lower portion, so that the periodic motion is created by the pivoting of the vertical rod about the pivot, with the flexible arm moving through an arc. The vertical rod may further include a second flexible arm spaced apart from the flexible arm and extending transversely from the upper portion of the vertical rod. The mass may be a ferric material; with a pair of electromagnetic coils located on opposing sides of the ferric material, where opposing activation of each electromagnetic coil driving the periodic motion of the flexible arm.

Figure 1B:
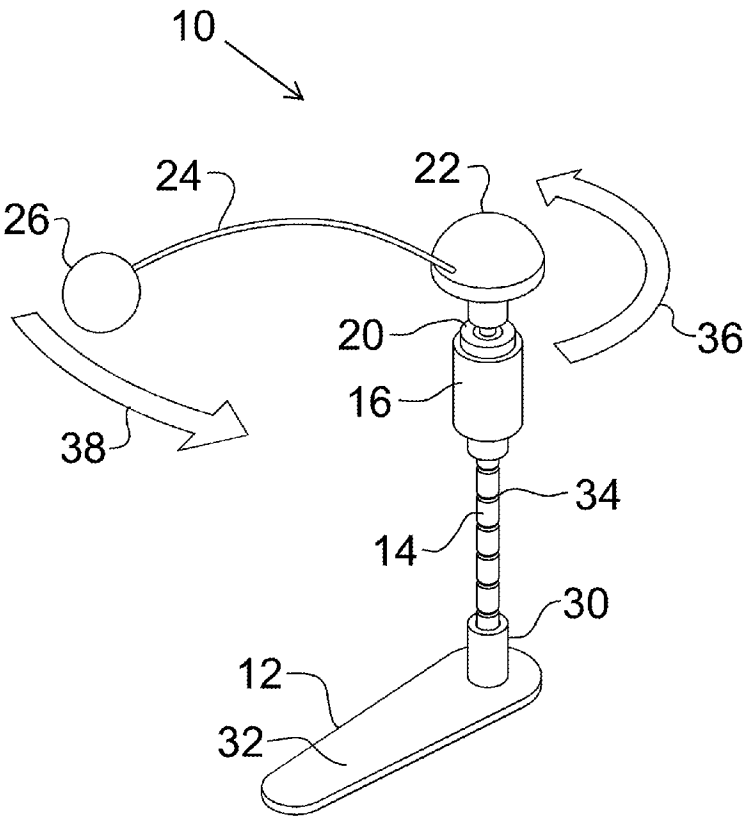
FIG. 1B is an assembled perspective view of the embodiment of FIG. 1A.
Figure 1A:
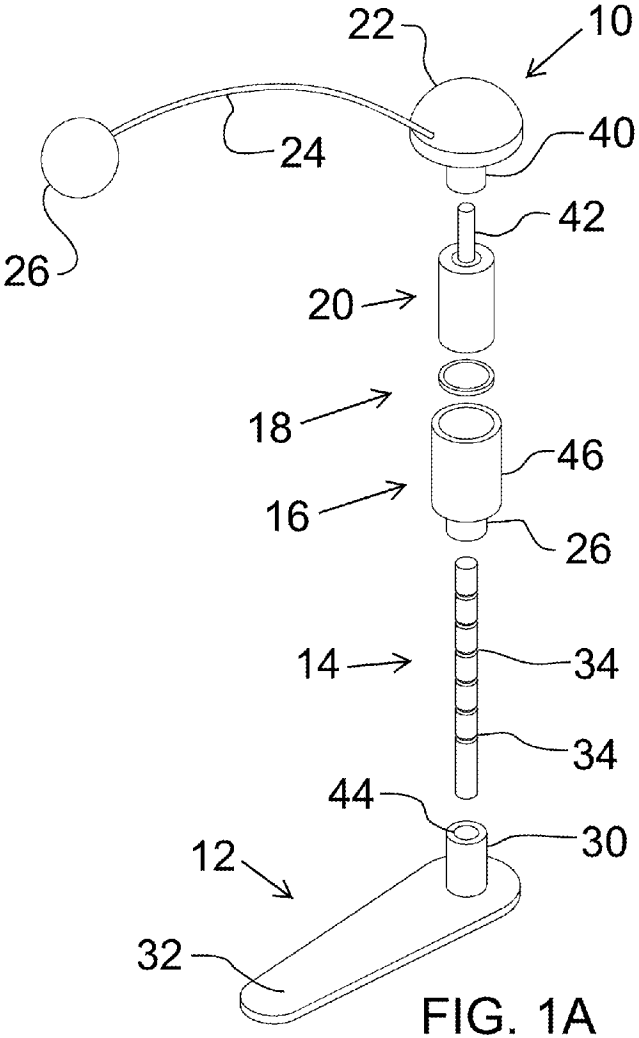
FIG. 1A is an exploded perspective view of a preferred embodiment of the present bobbling toy exciter.

| LISTING OF REFERENCE NUMERALS of FIRST-PREFERRED EMBODIMENT | |
|---|---|
| bobbling toy exciter | 10 |
| base | 12 |
| post | 14 |
| coupler | 16 |
| battery | 18 |
| motor | 20 |
| hub | 22 |
| wire | 24 |
| bob | 26 |
| boss | 28 |
| boss | 30 |
| platform | 32 |
| annular groove | 34 |
| arrow | 36 |
| arrow | 38 |
| boss | 40 |
| motor shaft | 42 |
| hole | 44 |
| motor cradle | 46 |
| joint | 48 |
| boss | 50 |
| leg | 52, 54 |
| arrow | 56 |
| solar panel | 58 |
| arrow | 60 |
| space | 62 |
| vertical rod | 64 |
| ferric material | 66 |
| buffer | 68 |
| pivot support | 70 |
| hub | 72 |
| pivot | 74 |
| post | 76 |
| cover | 78 |
| electromagnetic coil | 80 |
| ceramic housing | 82 |
| upper portion | 84 |
| lower portion | 86 |
| rod slot | 88 |
| bobbling toy | 100 |
| toy head | 102 |
| toy platform | 104 |
| toy body | 106 |
| neck | 108 |

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Figures 2, 3, 4:
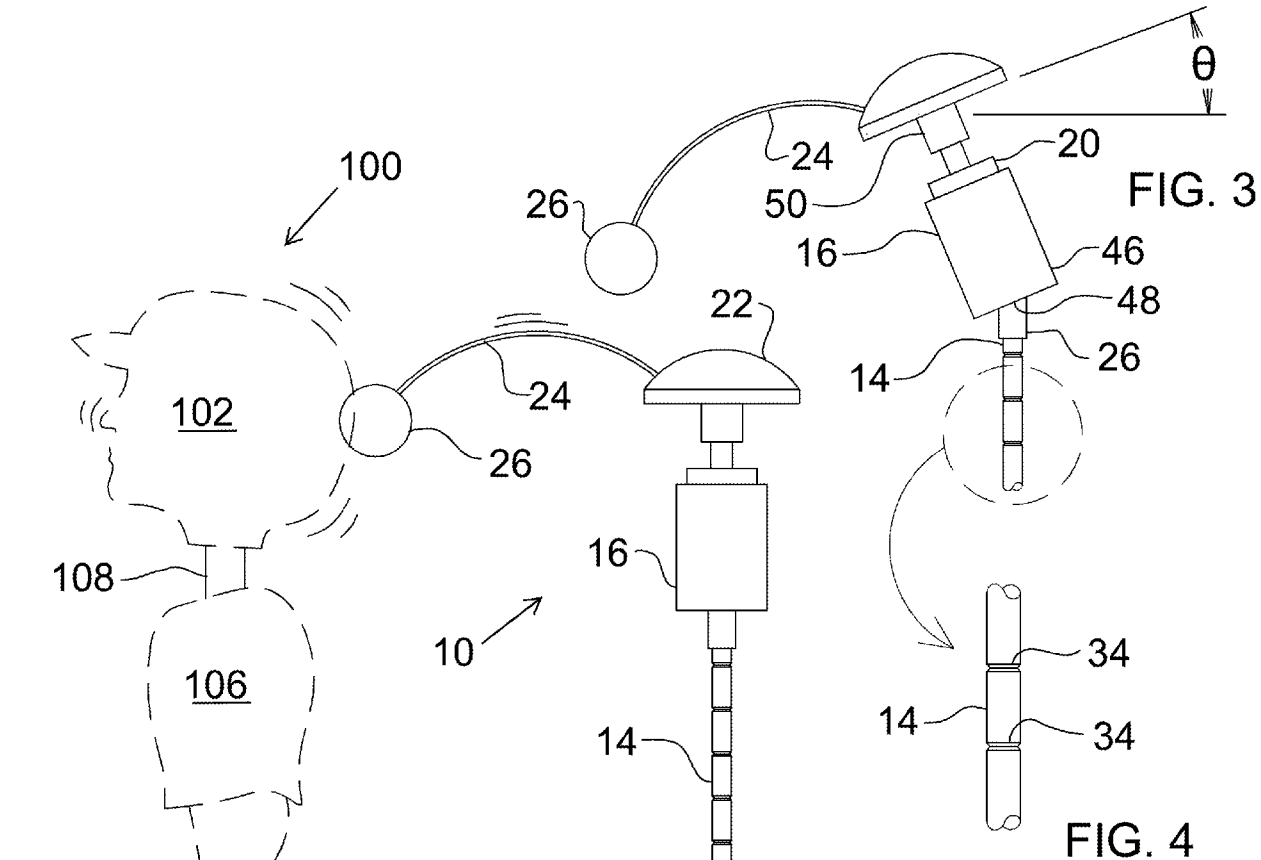
FIG. 2 is a side plan view of the embodiment of FIGS. 1A-B, showing the present bobbling toy exciter exciting the head of an exemplary bobbling toy.
FIG. 3 is a partial plan view of an alternate embodiment, showing the motor mounted in a tilted configuration.
FIG. 4 is a magnified partial plan view of the segmented frangible post.

FIGS. 1-8 illustrate several example embodiments of the present bobbling toy exciter (10). The exemplary embodiment shown in FIGS. 1A-B, and 2 illustrate a bobbling toy exciter (10) in which the motor (20) or other drive unit is elevated above the base (12), supported by a post (14). The base (12) has a platform (32) for supporting the post (14). A boss (30) with an axial hole (44) extends upwardly from the platform (32). The axial hole (44) is sized to receive the end of the post (14) in frictional, adhered, or mechanical engagement.

A coupler (16) joins the motor (20) to the post (14), where a boss (26) extends downwardly from the coupler (16) to receive the top end of the post in frictional or mechanical engagement within a hole (not visible) in the boss (26). A motor cradle (46) extends upwardly, where the motor (20) is inserted and held within the motor cradle (46), with the motor shaft (42) extending in a generally upward direction. In the illustrated example, the motor cradle (46) is a hollow cylinder sized to hold the motor (20) in frictional, adhered, or mechanical engagement.

In this embodiment, a coin-type battery (18) is inserted into the motor cradle (46) with the motor (20) inserted thereover. Standard electrical contacts connecting the motor, battery, and circuitry, if any, are well known in the industry, and are therefore not illustrated. The contacts connect the positive and negative poles of the battery to their respective motor leads. A slide switch (not illustrated) or other switch may be included to control the operation of the motor. Further, other means of activating and deactivating the motor are conceived, including a mechanism which completes the connection between the motor (20) and the battery (18) by applying pressure on the motor against a spring bias, or other known means.

A portion of the post (14) has been magnified in FIG. 4 to more easily view the segmented design, which permits the post (14) to be shortened by breaking off one or more segments at a weakened point in the post (14). In particular, the post (14) has a plurality of annular grooves (34) along its length, such that each annular groove (34) in the plastic post creates a point of weakness which permits the user to break the post (14). In this way, the post (14) may be shortened to move the motor (20) down from the maximum height permitted by the original length of the post (14). The post (14) may be divided by manual bending by pliers or by hand, or may be snipped by wire cutters, nipper, or the like. The post (14) may be made of a variety of materials, with a plastic material being preferred.

Mounted on the motor shaft (42) is a hub (22), with the motor shaft (42) being inserted into a hollow boss (40) extending downwardly from the hub (22). The motor shaft (42) may be secured to the hollow boss (40) with adhesive, a radially extending pin, by screw, or other securing means. A flexible arm (24), made of wire, fiber, filament, bristle, or other elongated flexible element, extends from the hub (22), with the base of the flexible arm (24) molded to the hub (22) or threaded through a hole in the hub (22). At the terminus of the flexible arm (24) is mounted a bob (26) or other mass which may strike and excite the toy head (102). Although, the embodiments of FIGS. 1-8 illustrate a bob (26) at the end of the flexible arm (24), the flexible arm (24) itself may strike the toy head (102) without the bob (26).

As can be seen in FIG. 1B, the base (12) holds the post (14), the motor (20) assembly, and the hub (22) assembly above the support surface upon which the base (12) rests. The motor (20) is connected to the motor cradle (46) portion of the coupler (16), such that the motor (20), the coupler (16), the post (14), and the base (12) remain stationary, while the motor shaft (42) rotates. As the motor shaft (42) rotates, the attached hub (22) rotates, as illustrated by the arrow (36). Accordingly, the flexible arm (24) with the attached bob (26) is rotated by the hub (22), as illustrated by arrow (38).

FIG. 2 illustrates an exemplary system and method of using the present bobbling toy exciter (10). A bobbling toy (100) is shown in phantom at the instant the bob (26) strikes the head (102) to excite or bobble the head (102). The head (102) is attached to the neck (108) through an internal spring (hidden), which permits the head (102) to bobble relative to the body (106) and the base (104). Although a toy (100) is illustrated with a bobbling head (102), the present bobbling toy exciter (10) may be used to excite any movable or bobbling portion of a bobbling toy or figurine.

The bobbling toy exciter (10) is preferably positioned to the rear of the bobbling toy (100) so as to not block the view of the toy, yet in close proximity. The user may position the bobbling toy exciter (10) to the side or forward of the bobbling toy (100) as well, depending on the space available and the user's preferences. The position of the bobbling toy exciter (10) should be just close enough to permit the bob (26) to strike the bobbling portion, the head (102) in this case. The flexible wire (24) bends and flexes to provide some leeway, such that the bob (26) does not strike the head (102) with too great a force. Furthermore, the flexible arm (24) flexes to permit the bob (26) to pass by the head (102), once struck, and continue the rotation (38) or periodic movement, perhaps albeit a disturbed rotation.

The bob (26) can be made of many suitable materials. It should have sufficient mass to excite the head (102), yet not so much mass that the head (102) is marred or damaged. For example, a small rubber ball approximately 0.25-0.5 inches in diameter may be suitable. The bob (26) may be made of bunched or compressed felt or a composite of two or more materials. Further, the material preferably should not cause a substantial knocking sound when striking the head (102). Although the bob (26) is shown as being spherical, other shapes are possible.

One preferred rotational speed could be approximately 20 revolutions per minute. The speed may vary depending on the attributes of internal spring of the bobbling toy (100), where a higher spring constant may require a higher rotational speed, or a lower spring constant may require a lower rotational speed. Furthermore, the user may desire a particular speed to just keep the head (102) bobbling. The speed may be made adjustable by a resistive means, such as a potentiometer, or through pulse-width modulation. If the motor (20) speed is kept constant, it is preferable to source a motor which is appropriately designed for slow rotation.

FIG. 3 shows an alternate embodiment, where the coupler (16) has a joint (48) between the motor cradle (46) and the boss (26), which permits the cradle (46) to tilt relative to the boss (26). In this way, the bob (26) will rotate about an axis which is tilted relative to the support surface upon which the bobbling toy (100) and the base (12). Therefore, the bob (26) will strike the head (102) at a diagonal vector, to cause up and down and side-to-side wobbling simultaneously. The joint (48) may be adjustable or permanently fixed a set angle.

Figure 5A:
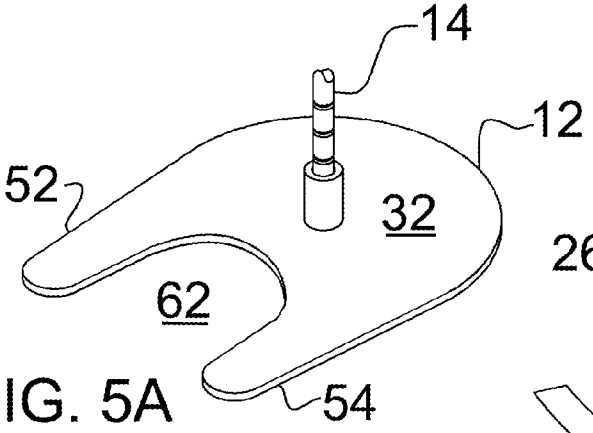
FIG. 5A is a partial perspective view of alternate embodiments of the present base.
Figure 5B:
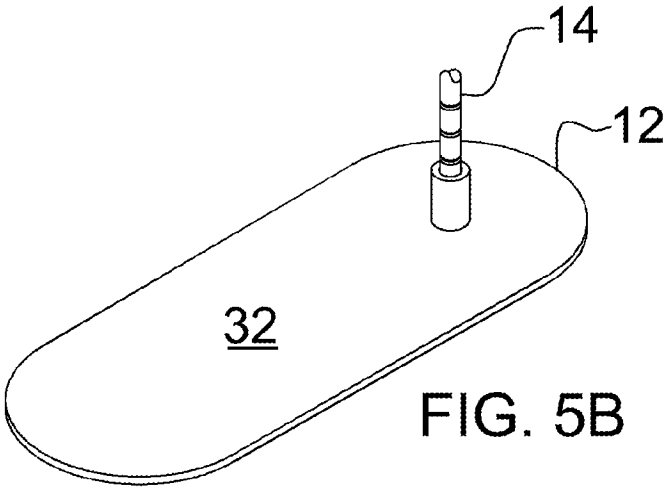
FIG. 5B is a partial perspective view of alternate embodiments of the present base.

FIGS. 5A-B illustrate two alternate embodiments of the base (12) of the present bobbling head exciter (10). In FIG. 5A, the base (12) has two legs (52, 54) with a space (62) between them. The space (62) is sufficiently wide to permit base (104) of the bobbling head toy (100) to rest between the legs (52, 54). In FIG. 5B, the base (12) has an enlarge platform (32), which is sufficiently large to support a bobbling toy (100) thereatop. Looking back at FIG. 2, the bobbling toy (100) does not rest on or between portions of the base (12). Furthermore, each embodiment of the base (12) is preferably weighted to prevent toppling or excessive shaking of the bobbling head exciter (10). Alternatively, the base (12) may be secured to a support surface, such as a table or shelf, by double-stick tape, museum or earthquake putty, or other securing or adhering means.

Figure 6:
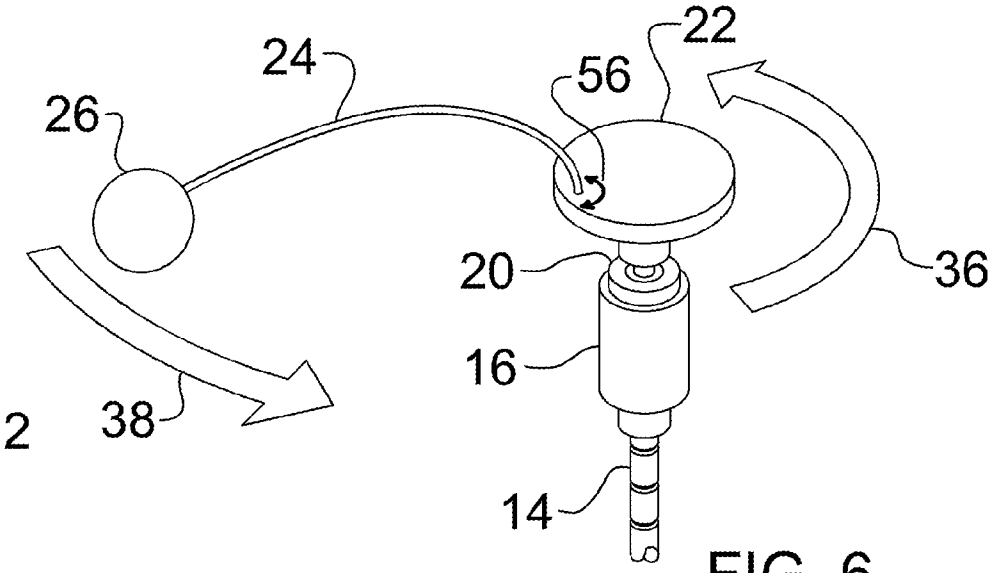
FIG. 6 is a partial perspective view of an alternate embodiment.

Yet another alternate embodiment is illustrated in FIG. 6. The flexible arm (24) is threaded through a hole in the hub (22) and bent or secured to prevent withdrawal. The flexible arm (24) is permitted to rotate about an off-center point on the hub (22), as shown by arrow (56). The hub (22) rotates with the motor shaft (42), which causes a general rotation of the bob (26) about the hub (22), as shown by arrow (38). As the hub (22) rotates the flexible arm (24) and bob (26), the flexible arm (24) and bob (26) are also permitted to rotate relative to the hub (22). This may serve to reduce the impact force of the bob (26) on the head (102) and may slow the rotation of the bob (26).

Figure 8:
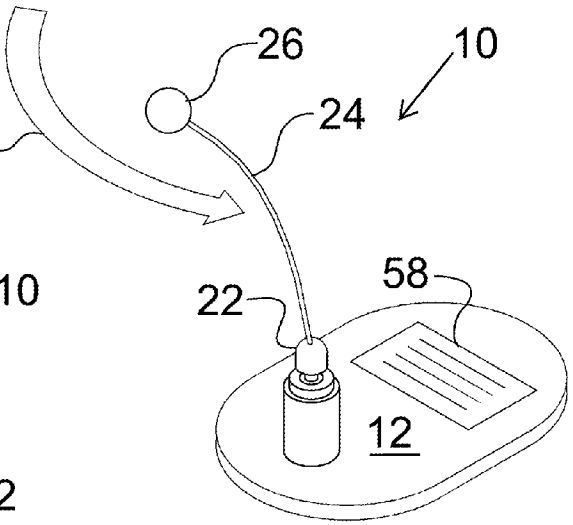
FIG. 8 is an assembled perspective view of the embodiment shown in FIG. 7
Figure 7:
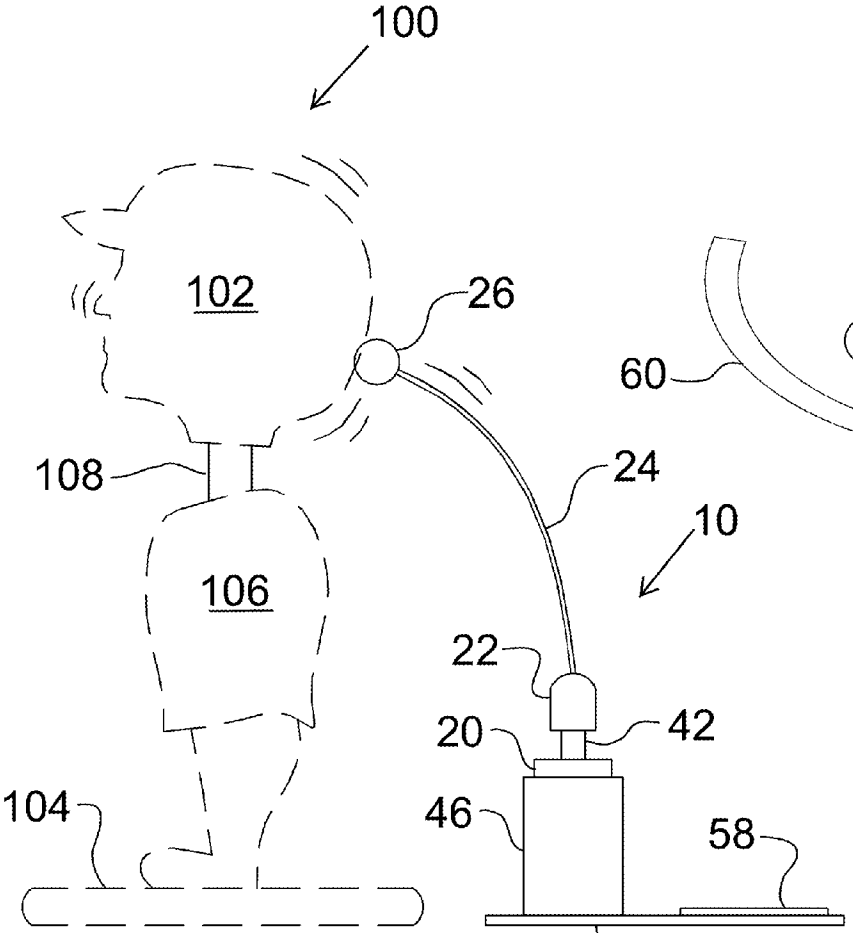
FIG. 7 is a side plan view of an alternate embodiment, showing the bobbling toy exciter exciting the head of an exemplary bobbling toy.

Another alternate embodiment is illustrated in FIGS. 7-8. The base (12) directly supports the motor cradle (46), eliminating the post (14), such that the motor (20) is in close proximity with or attached directly to the base (12). The hub (22) is shown as being smaller than previous embodiments, but may be similarly sized. The flexible wire (24) extends substantially centrally and axially out of the hub, with the flexible arm (24) bending outwardly, either being bent by the weight of the bob (26) or having a bend set in the flexible arm (24). The flexible arm (24) may also extend out of the hub (22) from a non-central position and/or in a non-axial configuration. Although a battery can be used with this embodiment, a solar panel (58) is shown. In fact, the solar panel (58) may be used in any of the embodiments described herein in place of a battery. Similarly, the motor may be power via an AC source converted to DC through a rectifier.

In operation, the embodiment of FIGS. 7-8 is positioned just behind the bobbling toy (100), such that the bob (26) will just strike the head (102) yet pass by the head (102) once stricken. Arrow (60) illustrated the rotation of the bob (26) about the motor shaft (42).

Figure 9:
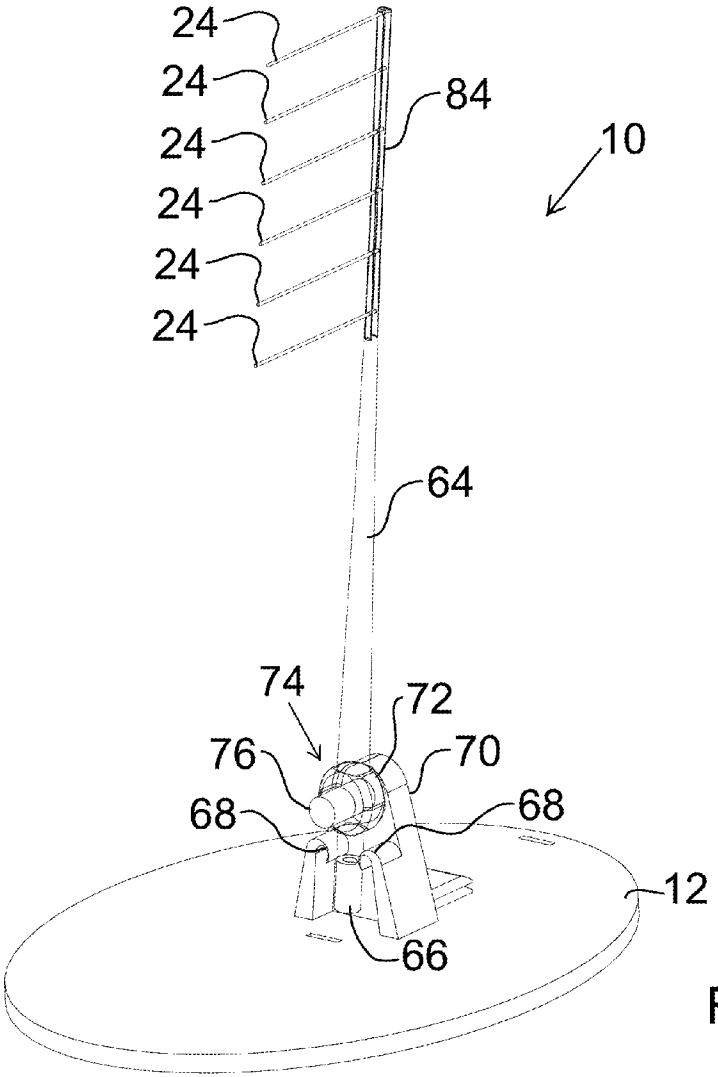
FIG. 9 is an assembled perspective view of an alternate embodiment of the present bobbling toy exciter.
Figure 10:
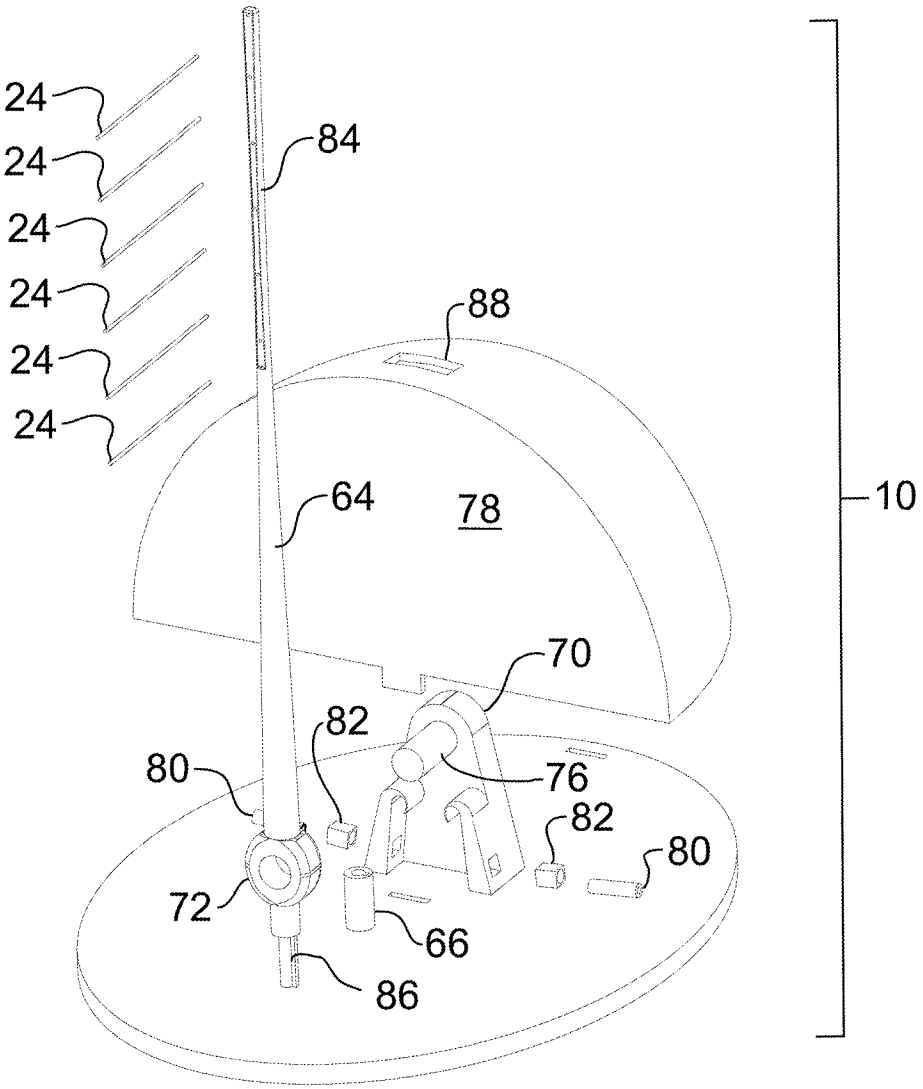
FIG. 10 is an exploded perspective view of the bobbling toy exciter of FIG. 9.

Yet another alternate embodiment of the present bobbling toy exciter is shown in FIGS. 9 and 10. In this embodiment, a vertical rod (64) pivots about pivot (74), where a hub (72) loosely fits over the shaft (76) which extends from the pivot support (70). Extending transversely from holes in the upper portion (84) of the vertical rod (64) are a series of spaced apart flexible arms (24). The flexible arms (24) may be made of a monofilament, a bristle material, or any other flexible elongated material. Although six flexible arms are shown, there may just be one. One or more of the flexible arms (24) may be trimmed to adjust for the shape or height of the bobbling toy. For example, for a tall bobbling toy, the lowest four or five flexible arms (24) may be eliminated by cutting, bending, or breaking, so that only the top one or two flexible arms (24) strike the bobbling toy.

A ferric material (66) is attached to the lower portion (86) of the vertical rod (64). A pair of electromagnetic coils (80) are positioned on opposing sides of the ferric material (66), inserted into the pivot support (70). Complementary and opposing activation of the electromagnetic coils (80) cause a force which pulls the ferric material (66) and the lower portion (86) of the vertical rod (84) towards the electromagnetic coil (80) producing the greatest force. Buffers (68), or other cushion or springs, may be incorporated on either side of the lower portion (86) to soften the change in direction of the vertical arm (84) as it pivots to and fro. Ceramic housings (82) may be used to isolate the plastic of the pivot support (70) from the heat produced by the electromagnetic coils (80).

The electromagnetic coils (80) may be controlled by a microcontroller, producing two opposing pulse width modulation sequences. By connecting the coils (8) to the microcontroller, and using transistors as buffers, the coils (80) can be energized in small, opposite increments which would ensure a clean, fluid motion of the vertical rod (64), and minimal power usage. As one coil (80) increases the intensity of its magnetic field, the other would decrease its intensity at an equal magnitude, also reducing heat, noise, and wear on the moving components. The frequency of the pulses, and therefore the oscillations can be modified and set by either a potentiometer or programming within the microcontroller.

A cover (78) may house the electronics (such as circuitry, the battery, and so on) and give the bobbling toy exciter (10) a pleasing appearance. A rod slot (88) is formed through the cover (78) to permit the vertical rod (64) to be inserted through, with sufficient clearance for pivoting. As the vertical rod (64) pivots to and fro, one or more of the flexible arms (24) brush against or strike the bobbling portion of the bobbling toy.

While particular forms of the invention have been illustrated and described, it will also be apparent to those skilled in the art that various modifications can be made without departing from the spirit and scope of the invention. Accordingly, it is not intended that the invention be limited except by the eventual claims.

What is claimed is:

1. A bobbling toy exciter, comprising:

a bobbling toy having a bobbling portion;

a base for supporting the bobbling toy;

a vertical rod having an upper portion and a lower portion, the vertical rod pivotably connected to a shaft of a pivot support on the base between the upper portion and the lower portion, so that periodic motion is created by a pivoting to and fro of the vertical rod about the shaft;

a series of flexible arms removably coupled to, and extending outwardly from, the upper portion of the vertical rod, the flexible arms extending over a bobbling toy support area of the base; and a motor configured to cause the lower portion of the vertical rod to have the periodic motion when activated to cause the series of flexible arms to move in an arc, the base supporting the motor;

wherein, in an operative mode, the bobbling toy is positioned within the bobbling toy support area so that the series of flexible arms periodically strikes the bobbling portion, causing the bobbling portion to bobble; and the series of flexible arms bends so that the series of flexible arms passes by the bobbling portion after striking the bobbling portion.

2. The bobbling toy exciter of claim 1 wherein the series of flexible arms is one of a wire, a bristle, a filament, and a fiber.

3. The bobbling toy exciter of claim 1 further comprising a ferric material attached to the lower portion of the vertical rod, and wherein the motor includes an electromagnetic coil located on opposing sides of the ferric material, and wherein opposing activation of each electromagnetic coil drives the periodic motion of the vertical rod.

4. The bobbling toy exciter of claim 1 wherein the base has a cover, the cover having a rod slot through which the vertical rod is disposed and configured to allow the periodic motion of the vertical rod, and the cover disposed on a portion of the base adjacent to the bobbling toy support area.

5. The bobbling toy exciter of claim 4 wherein the base is a plate with two apertures configured to interlock with two tabs protruding from the cover.

* * * * *